US005908345A

United States Patent [19]

Choi

[11] Patent Number: 5,908,345

[45] Date of Patent: Jun. 1, 1999

[54] PROGRAMMABLE TOY

[75] Inventor: Kei Fung Choi, Hong Kong, The Hong Kong Special Administrative Region of the People's Republic of China

[73] Assignee: Silverlit Toys (U.S.A.), Inc., City of Industry, Calif.

[21] Appl. No.: 09/008,378

[22] Filed: Jan. 16, 1998

[51] Int. Cl.[6] ..... A63H 17/36; A63H 17/00

[52] U.S. Cl. ..... 446/436; 446/457; 446/460; 701/36

[58] Field of Search ..... 446/431, 436, 446/457, 460, 437; 701/36; 180/204

[56] References Cited

U.S. PATENT DOCUMENTS

| | | | |
|---|---|---|---|
| 3,840,086 | 10/1974 | Burton | 446/460 |
| 4,654,659 | 3/1987 | Kubo | 340/825.76 |
| 4,712,184 | 12/1987 | Haugerud | 364/513 |
| 4,767,376 | 8/1988 | Hanzawa | 446/457 |
| 5,334,075 | 8/1994 | Kakizake et al. | 446/438 |

FOREIGN PATENT DOCUMENTS

| | | | |
|---|---|---|---|
| 2259915 | 12/1972 | Germany | 446/436 |

OTHER PUBLICATIONS

Leininger, "Heath's Hero–1 Robot", Jan. 1983 –Byte Publications, pp. 86–96.

*Primary Examiner*—Robert A. Hafer
*Assistant Examiner*—Laura Fossum
*Attorney, Agent, or Firm*—Oppenheimer, Wolff & Donnelly LLP

[57] ABSTRACT

A programmable device such as a toy or novelty item has a keyboard which can be activated by a user to set up any one of multiple different motions of the toy. Sounds and lights can be activated to coordinate with the movement. The toy can be a car or other device capable of moving in the environment.

17 Claims, 6 Drawing Sheets

PROGRAMMABLE TOY

BACKGROUND OF THE INVENTION

This invention relates to a programmable system for enabling an object, preferably a toy or novelty item, to perform a series of actions chosen by a user.

Many toys or novelty items are available in the market which can perform different actions instructed by a player through the use of a remote control device. Typically the use of the remote control device results in a specific action of a toy object, for instance a vehicle. The remote control systems are either infrared, or radio controlled and can only be used to instruct the vehicle to perform individual or separate actions. These kind items are limited in the variability of their performance.

Having a variable programmable toy or novelty item would have distinct advantages and benefits in the consumer market.

The invention is directed to overcoming the limitations of existing toys and novelty items.

SUMMARY OF THE INVENTION

The invention provides for an interactive programming system for a toy or novelty item. A user, by pressing appropriate keypad buttons can program or instruct an object to perform a series of preset actions. These actions are preset in that different keys are programmed to operate or effect different actions on the toy or novelty item. This can preferably be accompanied by selected sound effects and light reactions.

According to the invention the programmable toy includes a body which has a motor for actuating a motion generator which can be in the form of wheels or other devices to cause the body to move through the surrounding environment. There is a keypad which operates a series of control switches for operation by the user of the toy. The switches are connected to a programmed or programmable microprocessor for translating the received signals from the switches into control signals for operating the motor. The motor can thereby be caused to activate the body in different selected directions according to the action of the motor on the motive generator.

In a preferred form of the invention there is a microprocessor which includes a memory function with which predetermined instructions for action and sound effects can be stored. The activities and objects to perform the action and sound effects are determined as selected by the user.

The programming system is driven by an integrated circuit chip which is responsive to the different keys.

The invention is further described with reference to the accompanying drawings.

DETAILED DESCRIPTION OF THE PREFERRED EMBODIMENT

Figure 1:
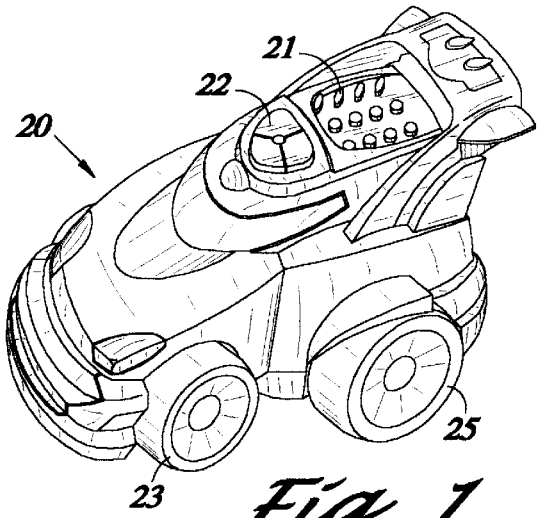
FIG. 1 is a perspective view showing a toy car in accordance with the invention.
Figure 2:
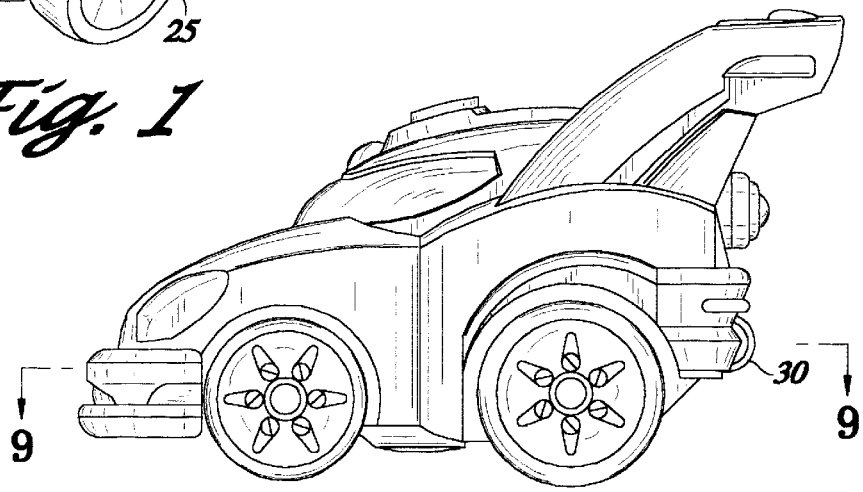
FIG. 2 is a side view of the car.

The invention is illustrated in relation to a car.

A vehicle 20 is shown with a keyboard 21 mounted on the top of the vehicle 20. There are twelve switches and there are also key switches 22 located in front of the keyboard 21. There are four spaced wheels, namely, front wheels 23 and 24 in the front of the vehicle 20 and rear wheels 25 and 26 in the rear of the vehicle 20. Wheels 25 and 26 are driven respectively by motors in a manner that will be described more fully below. The keyboard 21 includes three rows, each of four control switches. The row on the right side is generally indicated by numeral 27. Numeral 28 indicates the central row and numeral 29 is the row on the left side.

Figure 3:
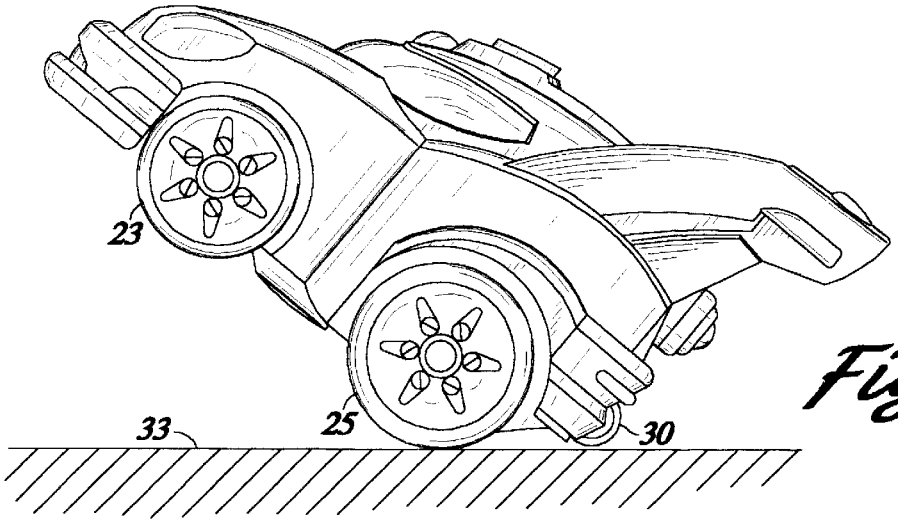
FIG. 3 is a side view showing the car on a surface in a pop wheel state.
Figure 4:
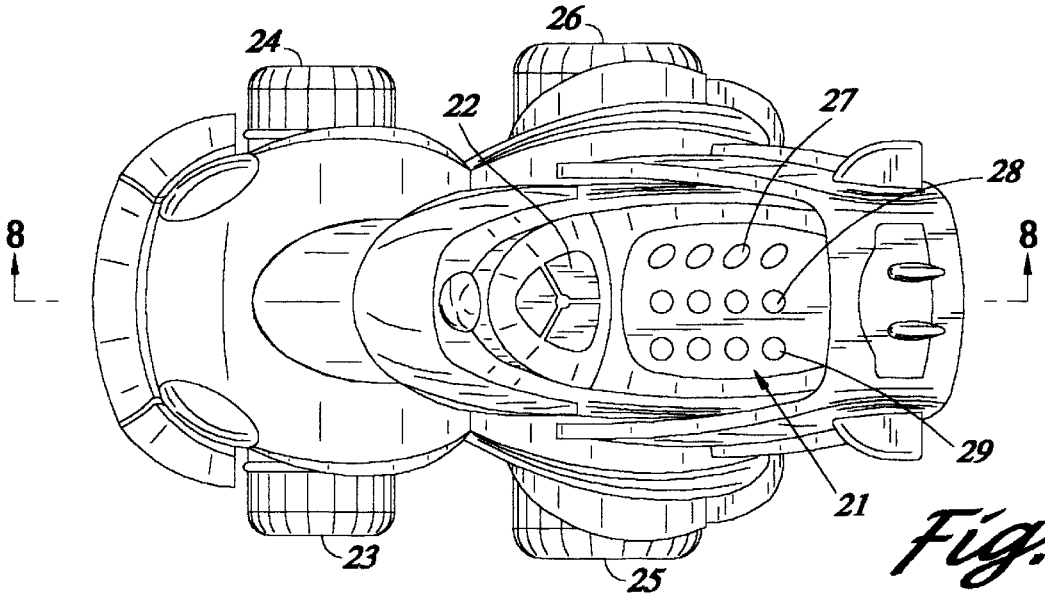
FIG. 4 is a top view of the car showing the keyboard with 12 keys and the three function switches.
Figure 5:
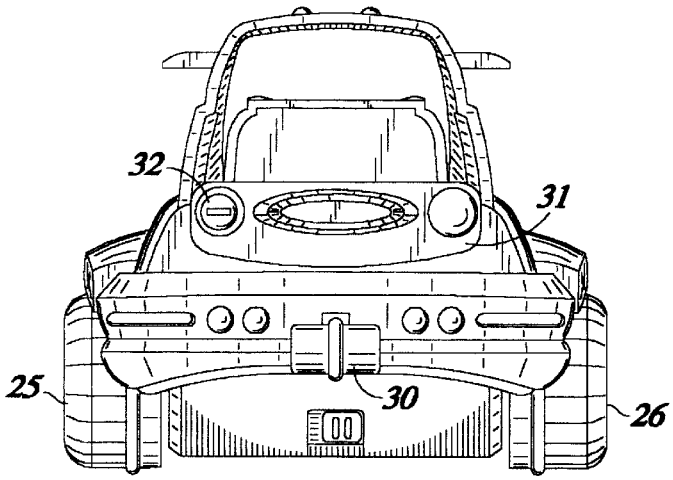
FIG. 5 is a rear view of the car.
Figure 6:
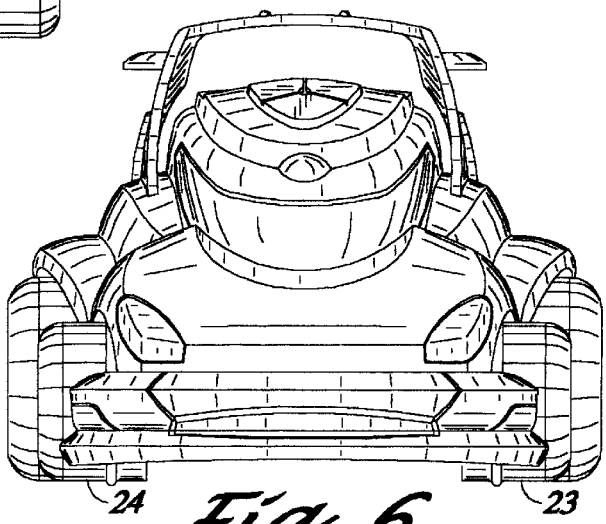
FIG. 6 is a front view of the car.
Figure 7:
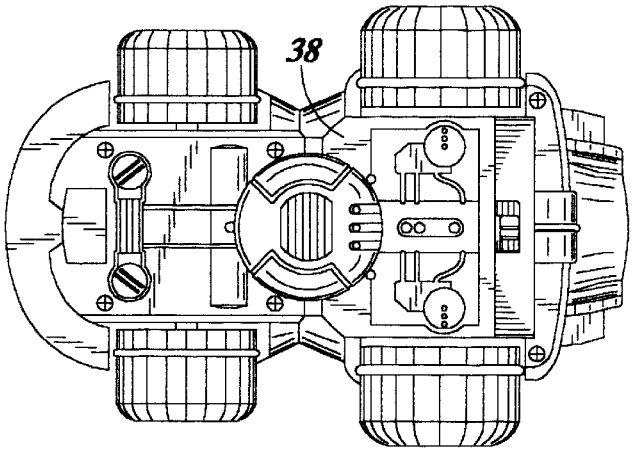
FIG. 7 is an underview of the car.

At the rear of the vehicle, there is a tranversely located rotatable roller 30, which is operational when the vehicle 20 tips as illustrated in FIG. 3 into a pop wheel position. The center of gravity of the vehicle in this situation is established so that the rear wheel 25 and roller 30 can balance the vehicle in this position. The control system permits for the vehicle to tip when an appropriate signal is inserted into the keyboard 21.

The rear of the vehicle includes a battery compartment 31, which has a door, and into which several batteries can be located. The battery compartment 31 can be opened through a door switch or lock 32, which is appropriately turned to provide access or closure to the battery compartment 31.

When the vehicle tips, it balances on the surface 33 so that the wheel 25 and the roller 30 engage on that surface. The operation of the vehicle is such that it can move on the surface 33 in a forward, rearward, left turn, right turn, or side sinusoidal direction with smaller or larger curves as programmed into the vehicle 20.

The front wheels 23 and 24 are mounted on a suspension mechanism 34 with a suitable helical spring 35. The shell of the body is shown as numeral 36, and can be cast as plastic having an upper portion 37, which can be screw connected with a lower portion 38. Within the molded plastic components, there are support elements which can form the structure of the internal workings of the car. This includes a floor 39 for the battery compartment 31.

Figure 8:
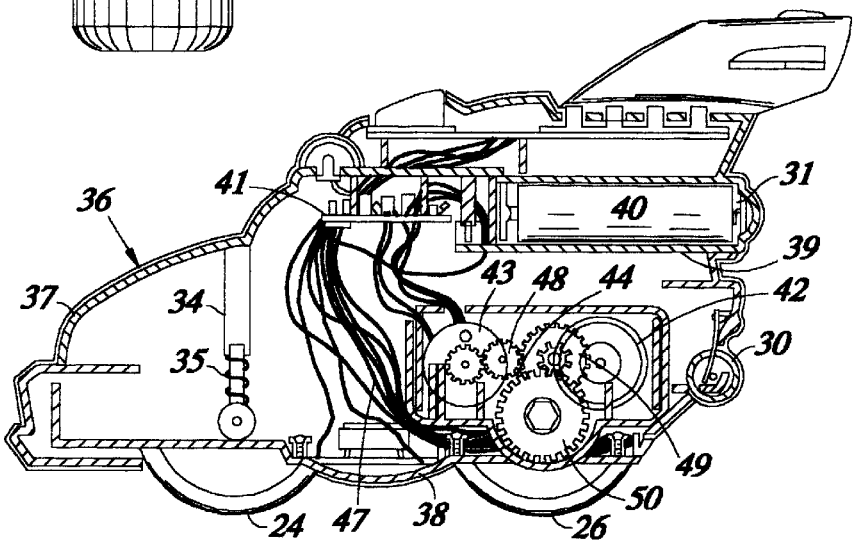
FIG. 8 is a sectional side view of the car showing the various mechanisms for driving the wheels and the electronic control system.
Figure 9:
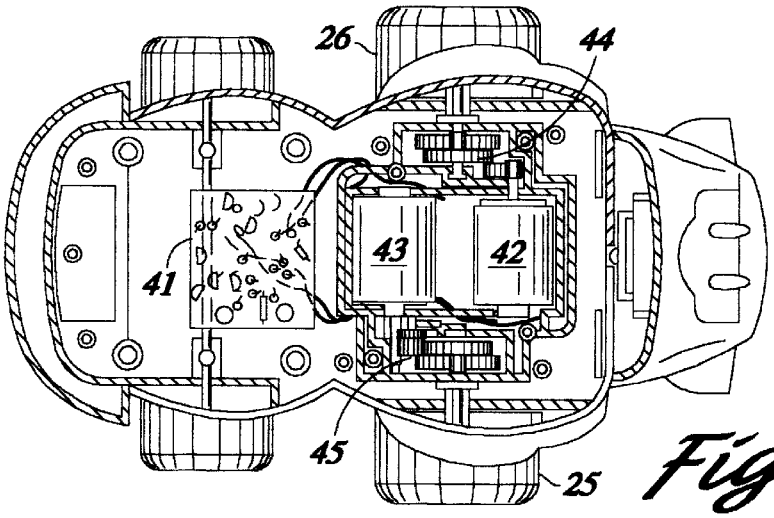
FIG. 9 is a sectional top view of the car showing the drive motors for driving the rear wheels of the vehicle.

At least one battery 40 is shown in the batter compartment 31 in FIG. 8. Mounted ahead of the battery compartment 31, there is a circuit board 41 which has in part the control circuit to drive two motors 42 and 43, respectively. Motor 42 is operational through a gear wheel mechanism 44 to operate the wheel 26, and motor 43 is operational through a gear wheel mechanism 45 to operate the wheel 25. Power from the control board 41 is directed through a series of conducting cables 47 to the motors, and in turn, the gear mechanisms. Gear mechanisms 44 include at least three interlocking gears 48, 49, and 50, which activate the wheel 26. A similar gear system 45 is applicable for wheel 25.

Figure 10:
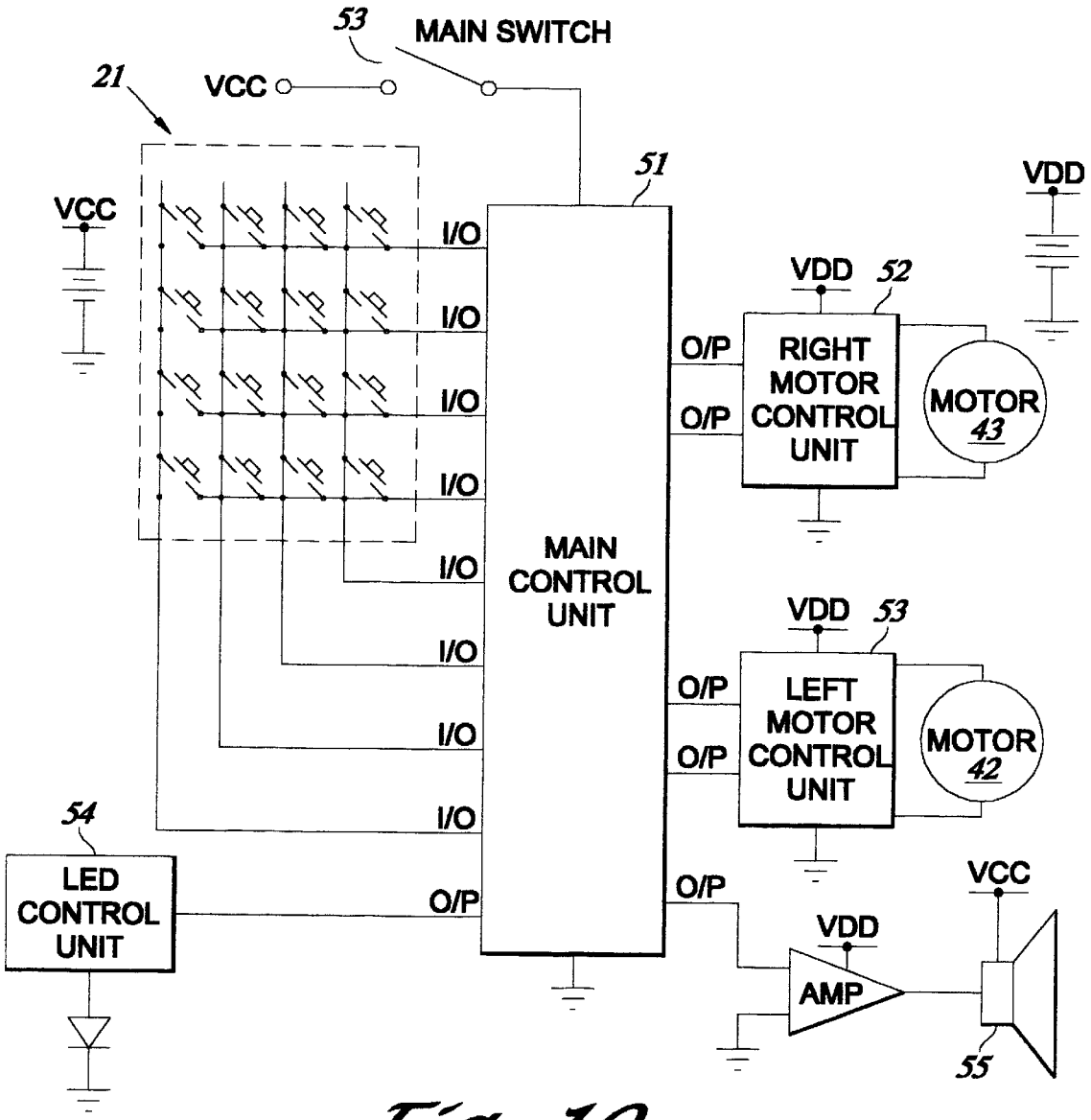
FIG. 10 is a block diagram illustrating the main components of the control units and the microprocessor.

In FIG. 10 there is shown a main control unit or microprocessor 51 connected with a right motor control unit 52 and a left motor control unit 53. The ON/OFF switch for the motor is represented in FIG. 10 by numeral 53, and the keyboard 21 is also shown with the multiple keyboard switches connected to the microprocessor main control unit 51. The keyboard switches are press button elements which close circuits as indicated in the keyboard configuration 21 as shown. The microprocessor also controls a light source LED control unit 54, which is operational under given programmed conditions of the processor 51. There is also a speaker 55 which is operational under the control of the microprocessor 51.

Figure 11:
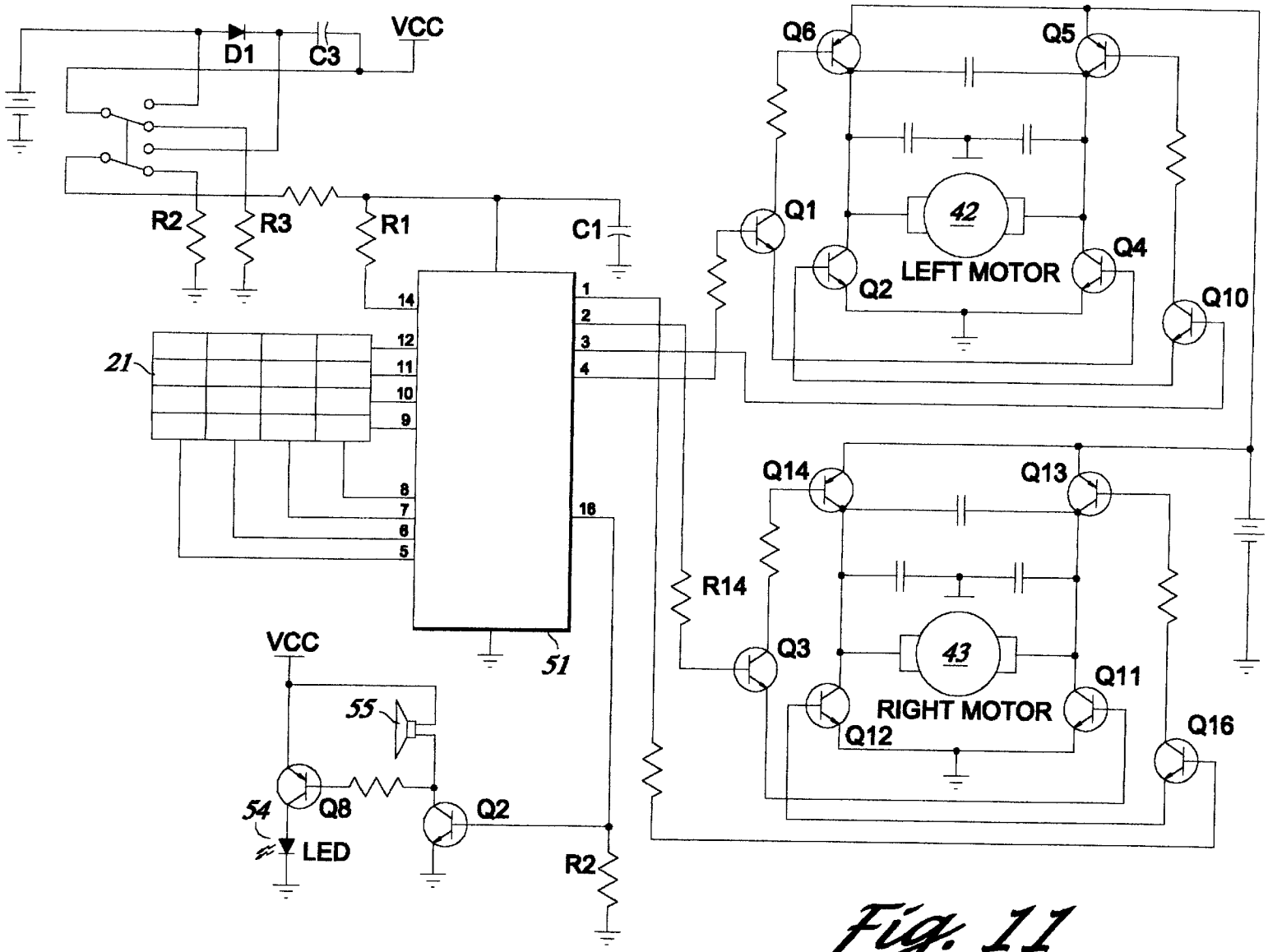
FIG. 11 is a more detailed view of the control circuits and the microprocessor.

The control circuit and microprocessor are described in further detail with reference to FIG. 11.

The control circuit drives the two motors 42 and 43 and a speaker circuit 55 and LED circuit 54. Transistor pairs are used for driver circuits. The microprocessor 51 has five outputs, labeled 1, 2, 3, 4, and 16. The inputs come from lines 5–12. When lines 5–12 present proper configurations given in the table, outputs 1–4 and 16 are driven by the microprocessor 51.

When output 1 goes high, the base of transistor Q16 receives the proper voltage to turn Q16 on, which allows current to flow through the collector and emitter of Q16. This, in turn, raises the voltages at the bases of Q13 and Q12 to turn Q12 and Q13 on, and since Q13 is connected to power, this passes current through right motor 43 in a first direction.

When output 2 goes high, the base of transistor Q3 receives the proper voltage to turn Q3 on, which allows current to flow through the collector and emitter of Q3. This, in turn, raises the voltages at the bases of Q11 and Q14 to turn Q11 and Q14 on, and since Q14 is connected to power, this passes current through right motor 43 in a second direction.

When output 3 goes high, the base of transistor Q10 receives the proper voltage to turn Q10 on, which allows current to flow through the collector and emitter of Q10. This, in turn, raises the voltages at the bases of Q5 and Q7 to turn Q5 and Q7 on, and since Q5 is connected to power, this passes current through left motor 42 in a first direction.

When output 4 goes high, the base of transistor Q1 receives the proper voltage to turn Q1 on, which allows current to flow through the collector and emitter of Q1. This, in turn, raises the voltages at the bases of Q4 and Q6 to turn Q4 and Q6 on, and since Q6 is connected to power, this passes current through right motor 43 in a second direction.

When output 16 goes high, the base of transistor Q2 receives the proper voltage to turn Q2 on, which allows current to flow through the collector and emitter of Q2. Since the collector of Q2 is connected to one of the speaker leads, and the other speaker lead is connected to power, this drives the speaker 55. Further, the collector of Q2 is connected to the base of Q8, and when Q2 is on, Q8 is on. When Q8 is on, current flows through the LED 54, causing it to emit light.

Example Toy and Operational Characteristics

An exemplary toy automobile with the programmable features has the following charateristics: an infinite amount of programming possibilities, about $128^{16}$; programmability; 8 action keys; 4 distance or timer keys; and 3 function keys. The function keys are designated as Go; Demo; and Shift keys.

Sound Effects can include screeching, honking, speeding, accelartion, engine noise and other verbal sounds. These sounds can be related to the action of the car.

Programmable Car

The dual motor programmable car is preset with 3 demo functions, there are also 8 action keys, 4 timer keys and shift keys for programming which store up 32 controlling features and 16 interactive process memory positions. The programmable car reproduces sound effects in following the movements. There is an LED light which acts and reacts and matches the action of the car.

When the ON/OFF is turned to be in the "ON" position, the car honks twice telling the user that it is ready. The demo button or program button is then used. Pressing the Demo Key8 once, twice or three times activates 3 different demonstration operations of the automobile.

The different levels of programming are the following.

Beginning Programming:

Press one Action Key and one Timer Key. Press "GO". Repeat the above basic function and add a second Action Key and a second Timer Key, before pressing "GO". The car holds up to sixteen different actions & timers on each run.

Intermediate Programming:

Adding the Shift Key (before the Action Key or the Timer Key) to the basic programming alters the original actions. Press the Shift Key and one Action Key at the same time. Then press a Timer key. Press "GO". This program alters the action making it different than the basic program. Press one Action Key. Then press the Shift Key and one Timer Key at the same time. Press "GO". This program alters the timing making it different than the basic program.

Advanced Programming:

Adding the Shift Key (before the Action Key and the Timer Key) to the basic programming alters the original actions. Press the Shift Key and one Action Key at the same time. Then press the Shift Key and one Timer Key at the same time. Press "GO". This program alters the action and timing making it different to the basic and intermediate program.

To interrupt the program while the car is in action, press the "GO" Key and the car stops. To repeat the last programmed action, press the "GO" Key and the car repeats the last programming. Should the user input the wrong program and want to start over, press the Shift Key down for 3 seconds. The car beeps telling the user that the memory has been erased. There is an automatic shut off after 30 minutes if the car is left in the "ON" position. Within these 30 minutes, a reminding horn sounds every five minutes inviting new play and programming.

If desired, function cards can be provided for multiple combination of keys.

The keys assignment are as follows:

Key Description

These are the keys located on the keyboard 21.

Key 1 (Action Key: 4 different modules)

Forward: Key 1+Timer Key (Time base 2.0 sec.)

Forward: Key 1+Shift (Timer) Key (Time base 0.5 sec.)

Turbo Forward: Shift (Key 1)+Timer Key (Time base 2.0 sec.)

Pause: Shift (Key 1)+Shift (Timer) Key (Time base 0.5 sec.)

Key 2 (Action Key: 4 different modules)

Backward: Key 2+Timer Key (Time base 2.0 sec.)

Backward: Key 2+Shift (Timer) Key (Time base 0.5 sec.)

Turbo Backward: Shift (Key 2)+Timer Key (Time base 2.0 sec.)

Vibration: Shift (Key 2)+Shift (Timer) Key (Time base 0.5 sec.)

Key 3 (Action Key: 4 different modules)

Turn Left Forward: Key 3+Timer Key (Time base 2.0 sec.)

Turn Left Forward: Key 3+Shift (Timer)

Irregular Polygon I: Shift (Key 3)+Timer Key

Rotate—Anti-clockwise: Shift (Key 3)+Shift (Timer) Key

Key 4 (Action Key: 4 different modules)

Turn Left Backward: Key 4+Timer Key (Time base 2.0 sec.)

Turn Left Backward: Key 4+Shift (Timer) Key (Time base 0.5 sec.)

Transverse Line (Left): Shift (Key 4)+Timer Key

Shaking 3 times: Shift (Key 4)+Shift (Timer) Key

Key 5 (Action Key: 4 different modules)

Sine-Curve (Small): Key 5+Timer Key

Sine-Curve (Big): Key 5+Shift (Timer) Key

Circle I: Shift (Key 5)+Timer Key

Circle II: Shift (Key 5)+Shift (Timer) Key

Key 6 (Action Key: 4 different modules)

Pop Wheelies: Key 5+Timer Key

Pop Wheelies & Down: Key 6+Shift (Timer) Key

Makes '8' small turns: Shift (Key 6)+Timer Key

Makes '8' bigger turns: Shift (Key 6)+Shift (Timer) Key

Key 7 (Action Key: 4 different modules)

Turn Right Forward: Key 7+Timer Key (Time base 2.0 sec.)

Turn Right Forward: Key 7+Shift (Timer) Key (Time base 0.5 sec.)

Irregular Polygon II: Shift (Key 7)+Timer Key

Rotate—Clockwise: Shift (Key 7)+Shift (Timer) Key

Key 8 (Action Key: 4 different modules)

Turn Right Backward: Key 8+Timer Key (Time base 2.0 sec.)

Turn Right Backward: Key 8+Shift (Timer) Key (Time base 0.5 sec.)

Transverse Line (Right): Shift (Key 8)+Timer Key

Pop Wheelies & Shaking 3 times: Shift (Key 8)+Shift (Timer) Key

Key 9 (Timer Key)

Time base×1

Key 10 (Timer Key)

Time base×2

Key 11 (Timer Key)

Time base×3

Key 12 (Timer Key)

Time base×4

The keys 22 are the following:

Shift Key (Shifts the different modules of Key 1 to Key 12)

The Shift key is simultaneously active with any one of the other keys.

Press and hold the Shift key for 3.0 seconds erases the input program.

Demo Key (Select 3 different pre-set program)

Press button once (Simple program function)

Press button twice within 2.5 seconds (Complex program function)

Press button three times within 2.5 seconds (Complicated program function)

Go Key (Start a program)

Press 'Go' key once after a program is completed to start theprogram

Press 'Go' key to stop the action when the car is moving

LED indicator

This is located in the car 20 and is synchronized with sound which is a speaker in the car 20.

Loudspeaker

Sound signal is preset and relates with functions

Voice signal is preset and relates to the 'Go' key

Motor Control

Drives the two DC motor forward or backward

Controls the speed of motor by the output current

Protects the circuit due to the back current

Operation Description

When the power is on, and the battery is charged, the system goes to a stand-by stage, and a sound signal is made, such a honking: "Beep . . . Beep . . . Beep". In the normal stand-by stage, the car performs a sound signal every 5 minutes (maximum 5 times) if no command is input or when the program has been completed. Programming is effected by a keying in procedure. The Action+Timer is one action process. There is a step by step keying in process, with a maximum of 16 interactive processes.

Example sequences of nine different keying sequences are now described. Whatever command keys are pressed, there is no right or wrong keying, and the car functions according to the last right keyed-in procedure. GP1, GP2, GP3 [Action Key and Time Key] represent right keying actions. Xa [Action Key Only] represents a wrong key only. Xt [Time Key Only] represents a wrong keying. Action 1, Action 2 represents programmed sequential movements, respectively.

1) GP1+GP2+GP3+Go. The car functions and goes through process of "GP1"+"GP2"+"GP3".

2) Xt+Go. The car functions but only goes through a process which has been set beforehand.

3) Xa+Go. The car is not activated.

4) GP1+GP2+GP3+Preset Action 1+Go. The car functions and goes through process of "GP1"+"GP2"+"GP3". "Go" key should be pressed within two seconds after the "preset action" key is pressed. Otherwise, the car performs the function in Preset Action 1.

5) GP1+GP2+GP3+Preset Action 1. The car functions and goes through the process of "Preset Action 1".

6) GP1+Xa+GP2+Xa+Go. The car functions and goes through the processes of "GP1"+"GP2".

7) Action1+Time1+Time2+Action2+Time1+Time2+Go. The car functions and goes through processes of "Action1+Time2" and then "Action2+Time2".

8) Go+Preset Action. The car functions but goes through the process of Preset Action. No program already existed.

9) Preset Action+Go. The car stops. "Go" key should be pressed within two seconds after the "preset action" key is pressed. Otherwise, the car performs the function in Preset Action 1.

At any time during the car's movements based on correctly keyed-in procedures, the car stops cancelling all programmed actions should the "Go" key be pressed.

Many other forms of the invention exist each differing from others in matters of detail only.

Figure 12A:
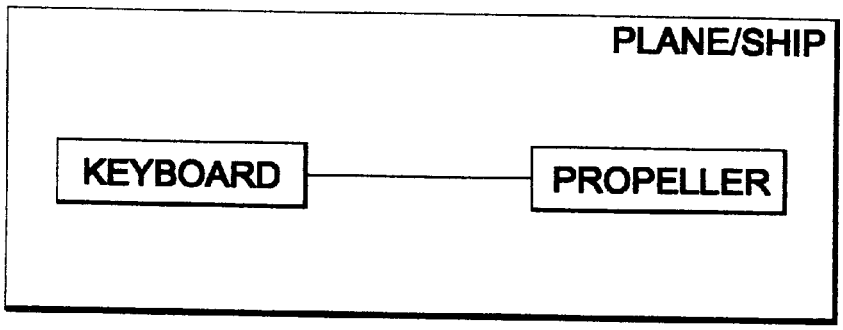
FIG. 12*a* is a representative view of a plane or ship having a keyboard and propeller.
Figure 12B:
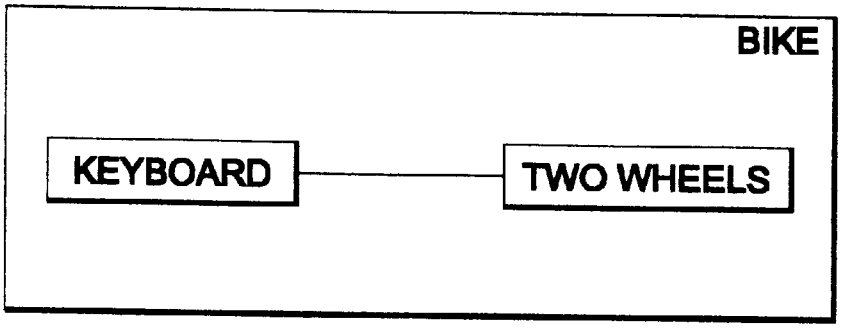
FIG. 12*b* is a representative view of a bike having a keyboard and two wheels.

Although the invention has been described with reference to a four-wheeled automobile vehicle it is clear that the invention also has application to other devices such as different toys or novelty items. The kind of toys could be a ship, plane, different kind of automobile such as a three-wheeler, or a motor bike, for instance as shown in FIG. 12B. The surrounding environment would be appropriately a surface, or could be the water in the case of a ship, or air in the case of a plane. In the case of a ship, boat, or plane, the motive generator can be a propeller or screw device. This is illustrated in FIG. 12A.

Figure 12C:
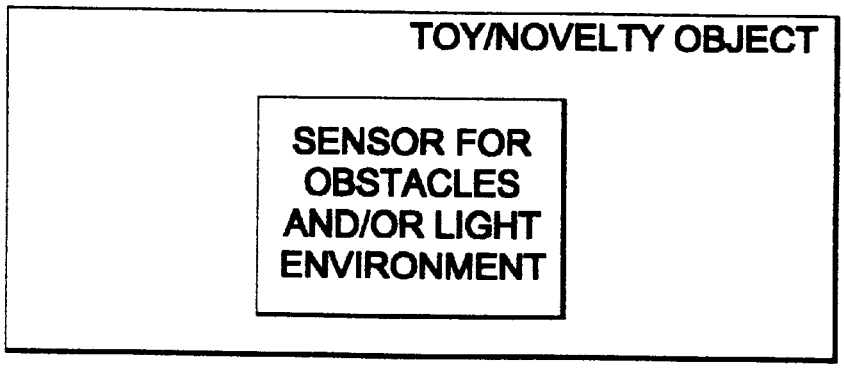
FIG. 12*c* is a representative view of a toy or novelty object where there is a sensor for obstacles and/or light environment.

Sensors for determining the environment could be to determine when the body approaches an obstacle and needs to veer in one direction or the other or stop. Changes in temperature or light could also be other things that the sensors could respond to and then cause the programmable microprocessor to vary the action which is preprogrammed into the device. This is illustrated in FIG. 12C.

In some situations, the programming can be effected remotely and be communicated by radio or infrared control.

The invention is to be determined solely by the following claims.

We claim:

1. A programmable toy device comprising:

a body;

a motor for activating a motive generator on the body for causing the body to move relative to a surrounding environment;

a key pad mounted on the body including a series of control switches for operation by a user;

the control switches being in the body and being connected with a microprocessor located in the body for translating signals received from the switches into control signals for operating the motor whereby the body is caused to move in different directions according to the action of the motor on the motive generator; and the arrangement being such that the motor, motive generator, key pad, switches and microprocessor are contained with the body, and wherein the switches and key pad are not operable or controllable under the action of a remote or detached controller, the body being representative of an automobile vehicle with four spaced wheels, two wheels being driven wheels, the two wheels being the motive generator, and wherein the center of gravity of the vehicle is located strategically relative to the wheels thereby to permit tipping of the vehicle according to the control of the wheel motion to thereby permit pop-wheeling.

2. A device as claimed in claim 1 wherein the driven wheels are the rear wheels of the automobile vehicle.

3. A device as claimed in claim 1 wherein the microprocessor is programmable so as to permit for a selection of motions including multiple motions of forward, backward, left turn, right turn or sinusoidal.

4. A device as claimed in claim 1 including a free roller element located towards the rear of the vehicle, the free roller element being for facilitating motion of the vehicle where the motion is in a tilted pop-wheeled state.

5. A device as claimed in claim 1 including a sound generator and a speaker for transmitting sounds, and means for selectively interacting, via activation of the motion generator, with sounds from the speaker.

6. A device as claimed in claim 1 including a light generator for creating light, and means for selectively interacting the light generator in relation to the activation of the motive generator.

7. A device as claimed in claim 1 wherein the microprocessor is connected to control means for operating the motor, and including control means for operating a light generator and a sound generator.

8. A device as claimed in claim 1 wherein the key pad permits the operation of multiple controls which is thereby to permit the selection of multiple combinations of motion of the body.

9. A device as claimed in claim 1 including sensors for determining the nature of the environment surrounding the device, and means for relating the nature of the environment as sensed selectively to activate a sound, light, or motion according to signals from the sensor.

10. A toy as claimed in claim 1 wherein the microprocessor is preprogrammed to activate respective motions and including a selected key on the key pad such that activation of the selected key activates the selected preprogrammed action of the respective motors.

11. A toy as claimed in claim 10 wherein the microprocessor is programmed for at least thirty-two actions.

12. A programmable toy vehicle comprising:

a body;

motor means for activating wheels on the body for causing the body to move on a surface;

a key pad located on the body including a series of multiple control switches for operation by a user;

the control switches being in the body and being connected with a microprocessor located in the body for translating signals received from the switches into control signals for operating the motor whereby the body is caused to move in different directions on the surface according to the action of the motor on the wheels;

the arrangement being such that the motor means, wheels, key pad, switches and microprocessor are contained with the body, and wherein the switches and key pad are not operable or controllable under the action of a remote or detached controller, the body being representative of an automobile vehicle with four spaced wheels, and wherein two wheels are driven by the motor means, the microprocessor being programmable so as to permit for a selection of motions including multiple motions of forward, backward, left turn, right turn or sinusoidal, the center of gravity of the vehicle being located strategically relative to the wheels thereby to permit tipping of the vehicle according to the control of the wheel motion and thereby to permit pop-wheeling;

a sound generator and speaker for transmitting sounds, and means for selectively interacting, via activation of the wheels, with sounds from the speaker;

a light generator for creating light, and means for selectively interacting the light of the light generator in relation to the activation of the wheels; and the microprocessor being connected to control means for operating the motor means, and control means for operating the light generator and the sound generator in the body, and wherein the key pad permits the operation of the multiple control switches thereby to permit the selection of multiple combinations of motion of the body.

13. A toy as claimed in claim 12 wherein the microprocessor is preprogrammed to activate respective motions, the light source and the sound generator, and including a selected key on the key pad such that activation of the selected key activates the selected preprogrammed action of the respective motors, light source and sound generator.

14. A toy as claimed in claim 13 wherein the microprocessor is programmed for at least thirty-two actions.

15. A programmable toy car comprising:

a body and four spaced wheels;

two motor means for activating a respective one of two wheels on the body for causing the body to move on a surface;

a key pad located on the body including a series of multiple control switches for operation by a user;

the control switches being in the body and being connected with a microprocessor located in the body for translating signals received from the switches into control signals for operating the respective motors whereby the body is caused to move in different directions on the surface according to the action of each motor on the respective one of the two wheels;

the microprocessor being connected to control means for operating the two motors, and control means for operating a light source and a speaker in the body;

the key pad permitting operation of the multiple controls thereby to permit the selection of multiple combinations of motion of the body; and the arrangement being such that the motors, wheels, key pad, switches and microprocessor are contained in the body, and wherein the switches and key pad are not operable or controllable under the action of a remote or detached controller, the center of gravity of the vehicle being located strategically relative to the wheels thereby to permit tipping of the vehicle according to the control of the wheel motion and thereby to permit pop-wheeling, and the microprocessor being programmable so as to permit for a selection of motions including multiple motions of forward, backward, left turn, right turn or sinusoidal.

16. A toy as claimed in claim 15 wherein the microprocessor is preprogrammed to activate respective motions and including a selected key on the key pad such that activation of the selected key activates the selected preprogrammed action of the respective motors.

17. A toy as claimed in claim 16 wherein the microprocessor is programmed for at least thirty-two actions.

* * * * *